United States Patent [19]

Sponberg

[11] 3,969,953

[45] July 20, 1976

[54] TRACTOR FOOT PEDAL GUIDE

[75] Inventor: Gerald E. Sponberg, Seaside, Oreg.

[73] Assignee: Gerald E. Sponberg, Seaside, Oreg.

[22] Filed: Apr. 3, 1975

[21] Appl. No.: 564,760

[52] U.S. Cl. ..... 74/560; 74/563
[51] Int. Cl.[2] ..... G05G 1/14
[58] Field of Search ..... 74/560, 561, 562, 562.5, 74/563, 512, 594.4; 180/77 R

[56] References Cited

UNITED STATES PATENTS

| | | | |
|---|---|---|---|
| 93,740 | 8/1869 | Parsons | 74/561 |
| 1,120,460 | 12/1914 | Dunlap et al. | 74/563 |
| 2,707,036 | 4/1955 | Hollub | 74/562 X |
| 3,377,881 | 4/1968 | Lucas | 74/512 |

*Primary Examiner*—Samuel Scott
*Assistant Examiner*—F. D. Shoemaker

[57] ABSTRACT

A tractor foot pedal guide intended as an accessory for tractors and the like in place of conventional foot pedals, the pedal guide including a foot pedal plate and side members preventing a driver's foot from accidentally slipping off of an otherwise wet or muddy pedal.

1 Claim, 2 Drawing Figures

TRACTOR FOOT PEDAL GUIDE

BACKGROUND OF THE INVENTION

1. Field of the Invention

This invention relates generally to vehicle accessories and more particularly to a novel and improved tractor foot pedal guide.

2. Description of the Prior Art

It is well known that a slippery pedal, whether on the brake or the accelerator of a vehicle, is especially hazardous for the driver of the vehicle, especially over uneven and rough terrain, such as that encountered by a tractor.

It would thus be desirable to provide a foot pedal for a tractor type vehicle which would assure that the driver's foot would not slip therefrom when the foot pedal became slippery due to wet or muddy conditions.

SUMMARY OF THE INVENTION

The present invention recognizes the hazards associated with slippery foot pedals and provides a novel solution thereto in the form of a tractor foot pedal guide intended to receive a foot of the tractor driver in a manner preventing the inadvertent slipping of the driver's foot from the pedal in view of side members associated with the pedal plate.

It is a feature of the present invention to provide a tractor foot pedal guide which is relatively simple in its construction and which, therefore, may be readily manufactured at a relatively low cost and by simple manufacturing methods so that it can be retailed at a sufficiently low price to encourage widespread use and acceptance thereof.

A further feature of the present invention provides a tractor foot pedal guide which is possessed of few parts and which, therefore, is unlikely to get out of order.

Still a further feature of the present invention provides a tractor foot pedal guide which is of a rugged and endurable construction and which, therefore, may be guaranteed by the manufacturer to withstand rough usage while still being easy to use in reliable and efficient operation.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENTS

Figure 1:
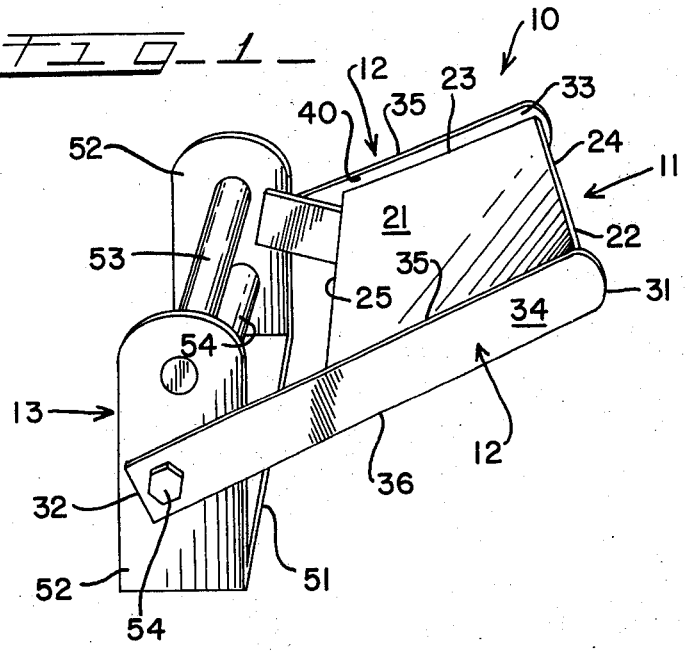
FIG. 1 is a perspective view of a first embodiment of the tractor foot pedal guide of the invention.

Referring now to the drawings in detail and in particular to FIG. 1, there is illustrated a first preferred form of a tractor foot pedal guide constructed in accordance with the principles of the present invention and which is designated generally in its entirety by the reference numeral 10 and which is comprised of a flat foot plate 11,side members 12, and mounting bracket 13.

Foot plate 11 is of a flat rectangular configuration having flat top surface 21, flat bottom surface 22, opposed side edges 23, and opposed end edges 24 and 25. The side members 12 are each identical to each other and are formed of flat elongated rectangular straps having opposite ends 31 and 32, interior surfaces 33, exterior surfaces 34, and top and bottom side edges 35 and 36.

The side edges 23 of plate 11 are secured between side members 12 to the interior surfaces 33 in a manner providing for a portion of the interior surfaces 33 to project upwardly relative to the plane of the foot plate 11 to define flanges or shoulder portions 40 which will engage the side of a driver's foot when resting on foot pedal 11 to prevent the driver's foot from inadvertently slipping off of the top surface 21 of the foot pedal.

The mounting bracket 13 is of a U-shaped configuration having a horizontal base 51 and a pair of vertical side arms 52, the side arms having a pair of cylindrical bolt members 53 and 54 extending therebetween with the ends 32 of side members 12 being pivotally secured to the exterior surfaces of side arms 52 by means of the bolt 54 so as to be pivotable about the axis of the bolt.

Figure 2:
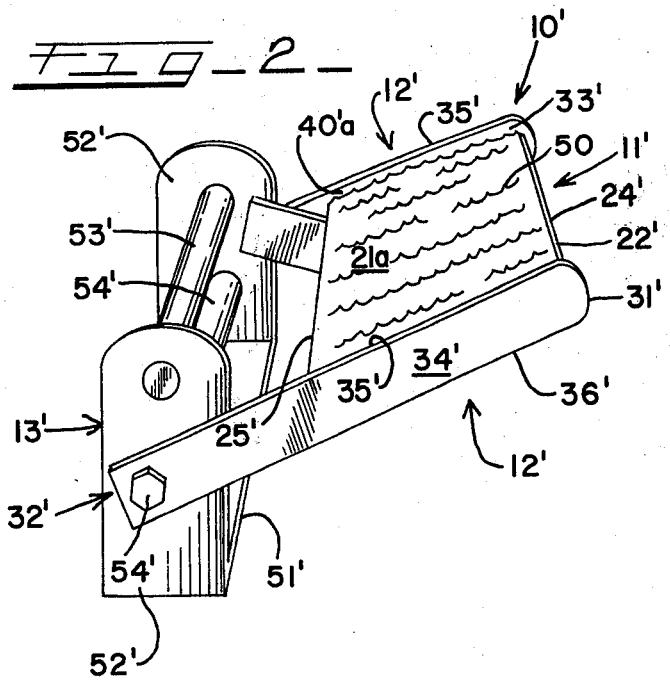
FIG. 2 is a perspective view of a second embodiment of the tractor foot pedal guide of the invention.

Referring now to FIG. 2 of the drawings, there is illustrated a second preferred form of a tractor foot pedal guide constructed in accordance with the principles of the invention and which is designated generally in its entirety by the reference numeral 10' and which is identical to the formerly described pedal guide of FIG. 1 except that the top surface of the foot pedal is now manufactured of a rubber material with non-slip treads to further assist in the grip between a driver's foot and the pedal plate. Due to the similarity between parts of the two forms of the invention, and in order to avoid needless repetition of description, similar reference numerals but having a single prime mark have been applied to the corresponding parts as between the disclosure of FIG. 1 and the disclosure of FIG. 2.

The foot pedal top surface **21*a* is provided with a rubber surface having treads 50** disposed thereover to provide a good grip between the pedal surface and the driver's foot even though the pedal may be wet or muddy, or even though the driver's shoe may be wet or muddy.

It is to be understood that the form of this invention herewith shown and described is to be taken as preferred examples of the same, and that this invention is not to be limited to the exact arrangement of parts show in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what I claim is:

1. A tractor foot pedal guide for use in preventing a tractor driver's foot from slipping off a foot pedal during wet or muddy conditions, the foot pedal guide comprising:

a foot plate for engaging a portion of the tractor driver's shoe wherein side members are affixed to the foot plate to prevent the driver's shoe from inadvertently slipping out of contact therewith, with the foot pedal guide being further characterized by a rubber member affixed over the top surface of the foot plate, and a plurality of treads disposed above the top surface of the rubber member to provide a better grip between the rubber member and the driver's shoe; and said side members provided on the tractor foot pedal guide being identical to each other with each being manufactured of an elongated flat strap like member having a flat exterior surface, a flat interior surface, opposed end edges, and opposed side edges, the side edges of the foot plate being joined to the interior surfaces of the side members with a portion of the side members projecting upwardly from the top surface of the foot plate to define foot engaging shoulders completely along the side edges of the foot plate for engaging a driver's shoe and preventing the driver's shoe from slipping off the foot plate, wherein the foot plate is of a flat rectangular member having a flat top surface, a flat bottom surface, opposed flat side edges, and opposed flat front and back end edges; and a mounting bracket having a U-shaped configuration with a flat horizontal base member and a pair of parallel spaced apart vertical side arms extending upwardly therefrom, a pair of vertically spaced apart horizontal parallel bolts extending between the side arms wherein one of the bolts extending between the side arms engages one of the end edges of each of the side members for pivotably retaining the side members to the mounting bracket for pivotal movement of the foot plate thereabout.

* * * * *